US006367583B1

(12) United States Patent
Derby

(10) Patent No.: US 6,367,583 B1
(45) Date of Patent: Apr. 9, 2002

(54) CAPTURE STRAP FOR A RESCUE HARNESS AND METHOD OF USE

(76) Inventor: Ronald C. Derby, P.O. Box 132132, Big Bear Lake, CA (US) 92315-8985

( * ) Notice: Subject to any disclaimer, the term of this patent is extended or adjusted under 35 U.S.C. 154(b) by 0 days.

(21) Appl. No.: 09/655,216

(22) Filed: Sep. 5, 2000

Related U.S. Application Data

(63) Continuation-in-part of application No. 09/624,365, filed on Jul. 24, 2000.

(51) Int. Cl.[7] ..... A47L 3/04

(52) U.S. Cl. ..... 182/3; 182/7; 119/857; 244/151 R

(58) Field of Search ..... 182/3, 4, 5, 6, 182/7, 8, 9, 65.1, 133, 134, 135, 136; 119/857, 769, 770; 244/151 R

(56) References Cited

U.S. PATENT DOCUMENTS 3,424,134 A * 1/1969 Rosenblum ..... 119/96
3,757,893 A * 9/1973 Hobbs ..... 182/6
4,455,718 A * 6/1984 Finnern ..... 405/186
4,746,084 A * 5/1988 Strong ..... 244/151 R
4,827,578 A * 5/1989 Heckerman et al. ..... 24/265
4,854,607 A * 8/1989 Mandracchia et al. ..... 280/801
4,938,436 A * 7/1990 Bradley et al. ..... 244/151 R
5,010,850 A * 4/1991 Sailer ..... 119/96
5,154,660 A * 10/1992 Snyder ..... 119/96
5,619,955 A * 4/1997 Nelson ..... 119/857
5,692,456 A * 12/1997 Louks-Phillips ..... 119/770
5,755,185 A * 5/1998 Gallagher ..... 119/792
6,125,792 A * 10/2000 Gee ..... 119/770

* cited by examiner

*Primary Examiner*—Bruce A. Lev
(74) *Attorney, Agent, or Firm*—Timothy Thut Tyson; Ted Masters; Freilich, Hornbaker & Rosen

(57) ABSTRACT

A capture strap (20) for rescue harness (500) includes a strap (22) having a first metal connector (28) connected to one end and a second cooperating metal connector (30) connected to the opposite end. The first (28) and second (30) metal connectors may be removably connected together so that capture strap (20) may be locked around a person being rescued. Capture strap (20) has two spaced apart harness connectors (32) and (34) for removably connecting capture strap (20) to the rescue harness (500).

3 Claims, 4 Drawing Sheets

CAPTURE STRAP FOR A RESCUE HARNESS AND METHOD OF USE

CROSS REFERENCE TO RELATED APPLICATION

This application is a Continuation-In-Part of application Ser. No. 09/624,365, filed Jul. 24, 2000, which is incorporated herein by reference.

TECHNICAL FIELD

The present invention pertains generally to torso harnesses which are utilized by rescue personnel to perform rescue operations while suspended from a safety line, and in particular to a capture strap which is attached to a rescue harness designed for use with a helicopter, and which is used to capture and contain the individual being rescued.

BACKGROUND ART

Harnesses for supporting a person while the person is suspended from a safety line are well known in the art. These devices include various types of rescue harnesses, safety harnesses for window washers and tree trimmers, mountain climbing harnesses, and parachute harnesses. For example, U.S. Pat. No. 3,757,893 shows an articulating leg sling and belt. The leg slings and safety belt provide combined articulation permitting freedom of movement. The belt has offset fastening means which permit sliding movement along a portion of the belt adjacent the attachment point to a carabiner. U.S. Pat. No. 4,938,436 illustrates a safety harness and belt assembly for aircraft crew members. The device includes left and right slings, a first belt assembly having first and second ends, a survival kit strap attachment fitting which slidably engages the belt assembly, and a mechanism for releasably attaching the fitting to a seat of the aircraft. The slings are designed to extend from the chest of the crew member over the crew member's shoulders, to the back of the crew member. U.S. Pat. No. 5,220,976 defines a safety harness to be worn by a worker especially a worker wearing a plastic suit for protection in a radioactive or chemically hostile environment. The harness comprises a torso surrounding portion with at least one horizontal strap for adjustably securing the harness about the torso, two vertical shoulder straps with rings just forward of the peak of the shoulders for attaching a lifeline and a pair of adjustable leg supporting straps releasably attachable to the torso surrounding portion. U.S. Pat. No. 5,531,292 discloses a harness with adjustable means for supporting a tool belt. The harness is arranged to suspend a tool belt, and comprises a pair of leg straps, a pair of upper torso straps, a pair of rappelling straps, a seat strap, and four belt suspenders. Each of the upper torso straps includes a chest strap portion and a back strap portion, with the chest strap portions extending across respective portions of the chest of the worker. U.S. Pat. No. 5,878,833 illustrates a fall prevention and lowering system. The systems consists of a rope grab, a body engagement device such as a harness, and a lanyard and lowering device.

Harnesses used for helicopter rescues have seen little development over the years. Most harness styles were developed years ago for work on chimneys, buildings, and rock climbing. Helicopter rescue operators have merely bought these preexisting harnesses, attached them to their cables, and taken off. There are four primary harness types: (1) vertical body orientation, (2) horizontal body orientation, (3) inverted body orientation, and (4) seated body orientation. The harness for seated body orientation is the most frequently used for cliff rescues. Horizontal body orientation is used for swift water rescues. In each scenario, the occupant cannot land and must rely entirely on the helicopter to provide support. The harness for inverted body orientation is used for descending narrow openings such as caves, elevator shafts, and holes. This scenario would be utilized by ground units such as urban search and rescues (U.S.A.R.).

DISCLOSURE OF INVENTION

The present invention is directed to a capture strap which is removably connectable to a rescue harness. The capture strap is utilized by a rescuer to surround, contain, and hold a person being rescued. The capture strap of the present invention is particularly useful in effecting swift water rescues using a helicopter in which the person to be rescued is being rapidly swept along by a river or other body of water.

In accordance with a preferred embodiment of the invention, a capture strap is fashioned from strap material having a first end and an opposite second end. A first metal connector is attached to the first end, and a cooperating second metal connector is attached to the second end. The rescuer holds the first and second metal connectors in his hands and slaps them together to lock the capture strap easily and rapidly around a person being rescued.

In accordance with another preferred embodiment of the invention, the capture strap has two spaced apart harness connectors for removably connecting the capture strap to two spaced apart receptacles on the chest portion of a rescue harness.

In accordance with an important aspect of the invention, the capture strap has a cross member to reduce the effective length of the capture strap, and thereby assist in capturing smaller persons.

Other features and advantages of the present invention will become apparent from the following detailed description, taken in conjunction with the accompanying drawings, which illustrate, by way of example, the principles of the invention.

MODES FOR CARRYING OUT THE INVENTION

Figure 1:
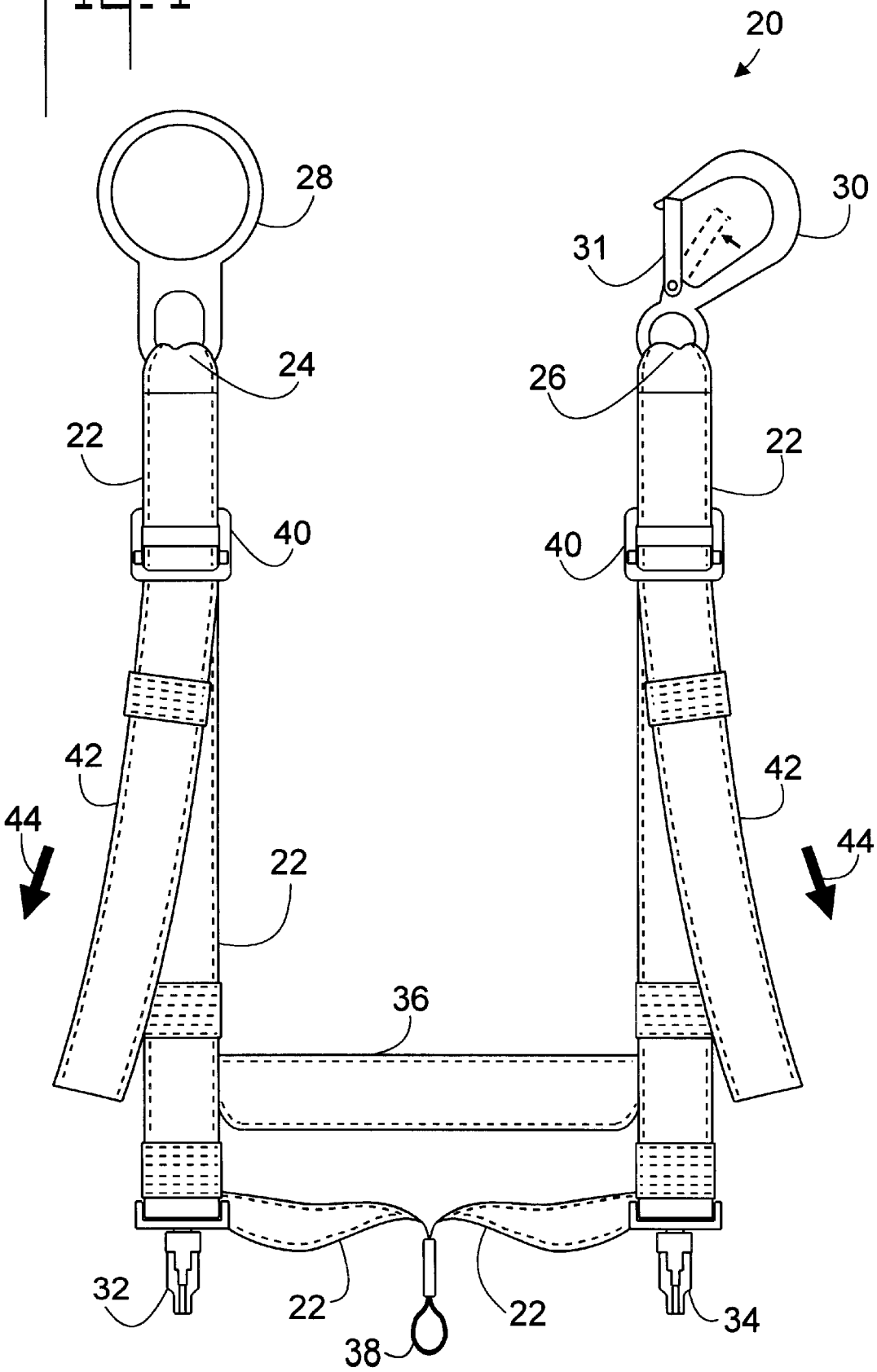
FIG. 1 is a plan view of a capture strap in accordance with the present invention.

Referring initially to FIG. 1, there is illustrated a plan view of a capture strap for a rescue harness 500 (refer also to FIG. 2) in accordance with the present invention, generally designated as 20. Capture strap 20 includes a strap 22 having a first end 24 and an opposite second end 26. A first metal connector 28 is connected to first end 24, and a second cooperating metal connector 30 is connected to second end 26. In a preferred embodiment, first metal connector 28 is a ring, and second metal connector 30 is a snap having a spring loaded gate 31 which is biased to a closed position. Second metal connector 30 is removabley connectable to first metal connector 28 so that capture strap 20 may be easily and rapidly locked around a person 600 being rescued (refer also to FIGS. 6 and 7). Prior art capture straps do not use metal to metal quick connect cooperating connectors. As such, prior art capture straps cannot be fastened as quickly and securely about the person 600 being rescued.

Figure 2:
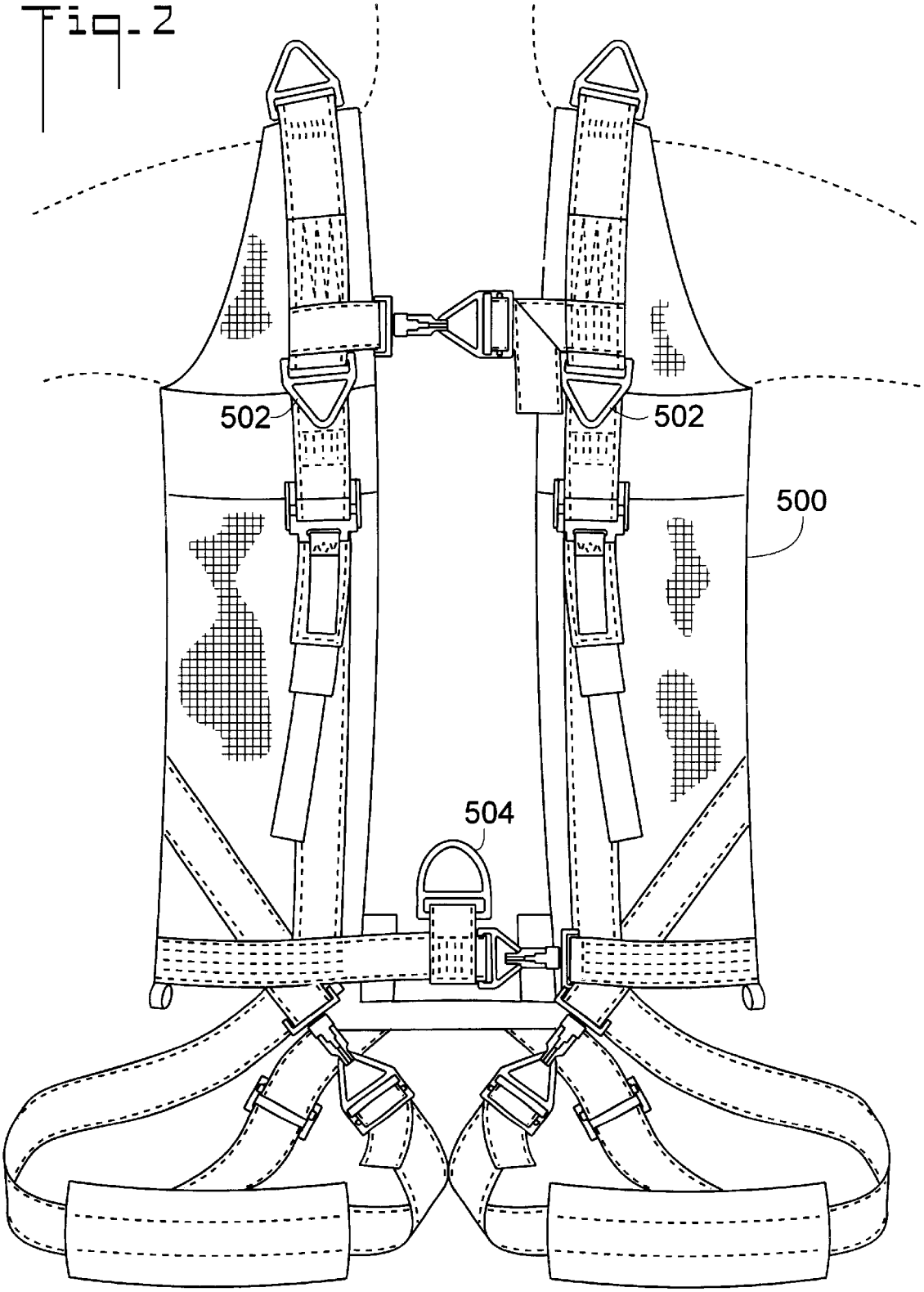
FIG. 2 is a front elevation view of a rescue harness.

Strap 22 has two spaced apart harness connectors 32 and 34 for removably connecting capture strap 20 to the rescue harness 500. Referring also to FIG. 2, rescue harness 500 has two spaced apart chest receptacles 502 for removably receiving two spaced apart harness connectors 32 and 34. The two spaced apart harness connectors 32 and 34 are connected to the two spaced apart chest receptacles 502 of rescue harness 500 to assemble the harness and capture strap for use.

Capture strap 20 additionally includes a cross member 36 connected across strap 22. Cross member 36 effectively reduces the length of strap 22, thereby ensuring that small persons 600 being rescued will not slip through capture strap 20.

Capture strap 20 also has a central connector 38, which is designed to be connected to a connector 504 on rescue harness 500 with a carabiner (refer also to FIG. 2). This configuration is most useful in performing rescues when the rescuer is in a substantially seated position suspended by a line from connector 504.

Capture strap 20 includes two adjustable buckles 40 which are attached to looped wrist straps 42 which receive the wrists of the rescuer 700 (also refer to FIGS. 3–7). After first and second connectors 28 and 30 are rapidly snapped together on the other side of the person 600 being rescued, wrist straps 42 are pulled generally outward in directions 44 thereby effectively shortening strap 22 to cinch the person 600 being rescued in the capture strap 20.

Figure 3:
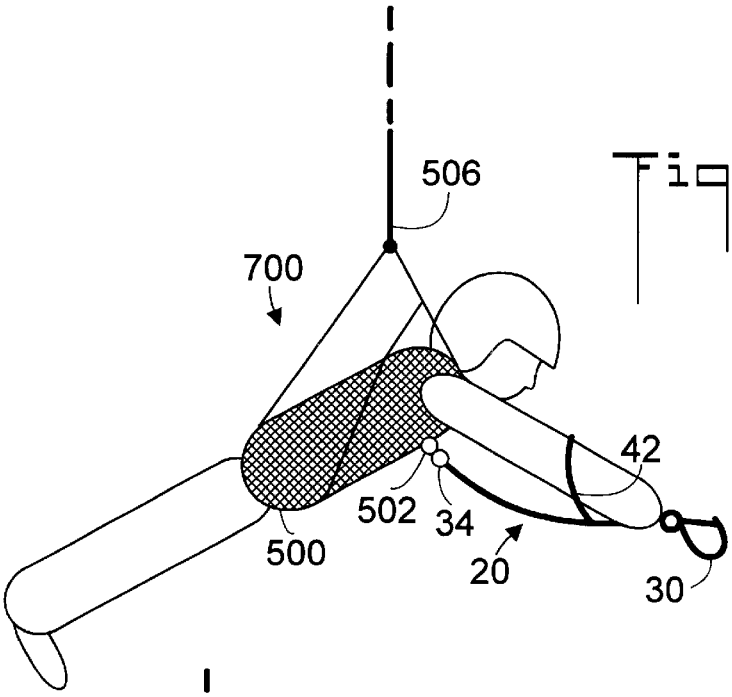
FIG. 3 is a reduced side elevation view of a rescuer poised to use the capture strap.
Figure 4:
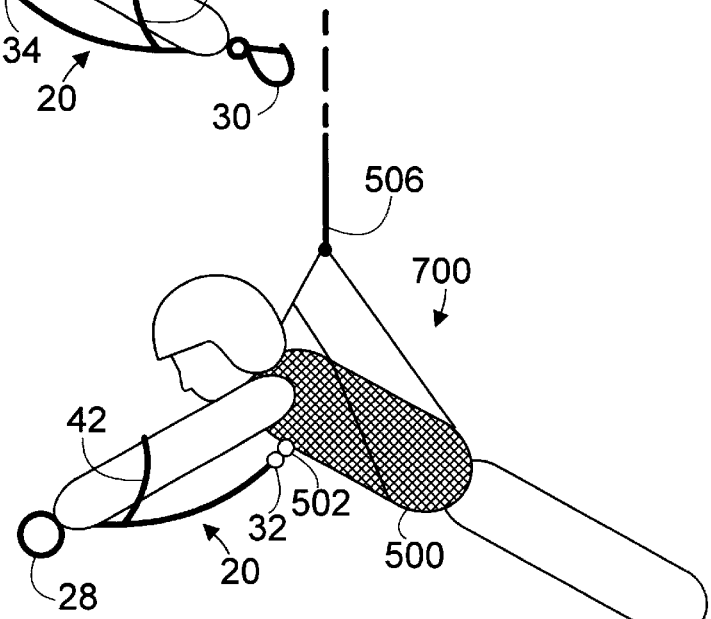
FIG. 4 is a reduced reversed side elevation view of the rescuer poised to use the capture strap.
Figure 5:
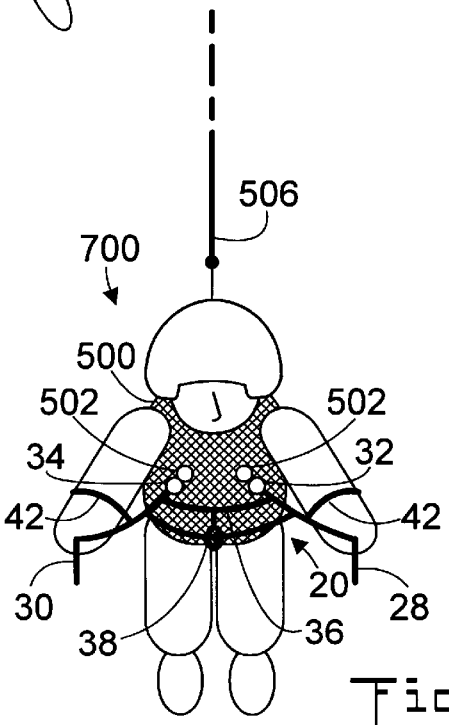
FIG. 5 is a reduced front elevation view of the rescuer poised to use the capture strap.

FIG. 3 is a reduced side elevation view of a rescuer 700 poised to use capture strap 20. FIG. 4 is a reduced reversed side elevation view of the rescuer 700. And FIG. 5 is a reduced front elevation view of the rescuer 700. Rescuer 700 is wearing rescue harness 500 and is suspended from a line 506, such as one emanating from a helicopter. The wrists of rescuer 700 are placed through wrist straps 42. Rescuer 700 is suspended in an angled forward facing ("peter pan type flying) position holding first metal connector 28 in his left hand and second metal connector 30 in his right hand. This is the typical position for performing swift water rescues, wherein the rescuer 700 is positioned downstream of and facing the person to be rescued 600. When the person 600 drifts into the arms of the rescuer 700, he is captured and secured with capture strap 20.

Spaced apart harness connectors 32 and 34 are connected to spaced apart chest receptacles 502 of harness 500. By spacing apart the harness and chest connectors, capture strap 20 is inherently aligned in a substantially horizontal plane ready to receive the person 600 to be rescued.

Figure 6:
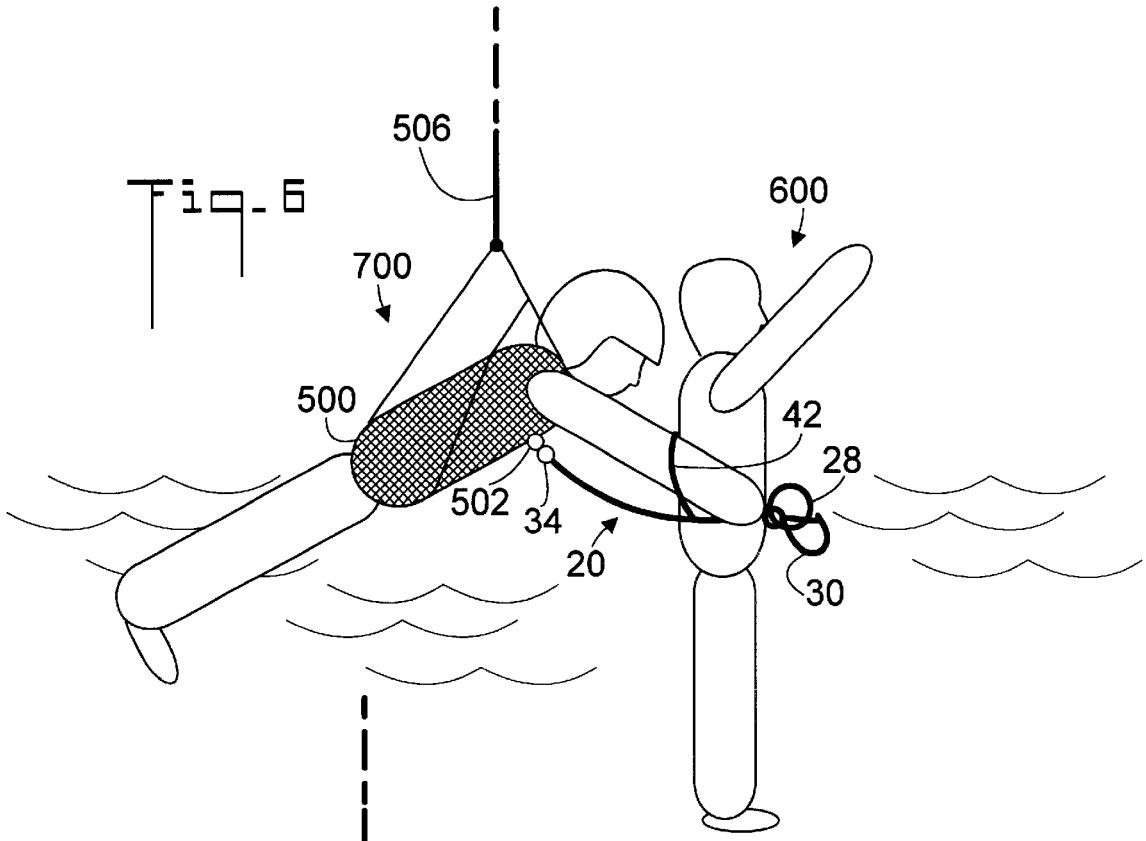
FIG. 6 is a reduced side elevation view of the rescuer placing and locking the capture strap around a person being rescued; and, FIG. 7 is a front elevation view of the rescuer placing and locking the capture strap around the person being rescued.
Figure 7:
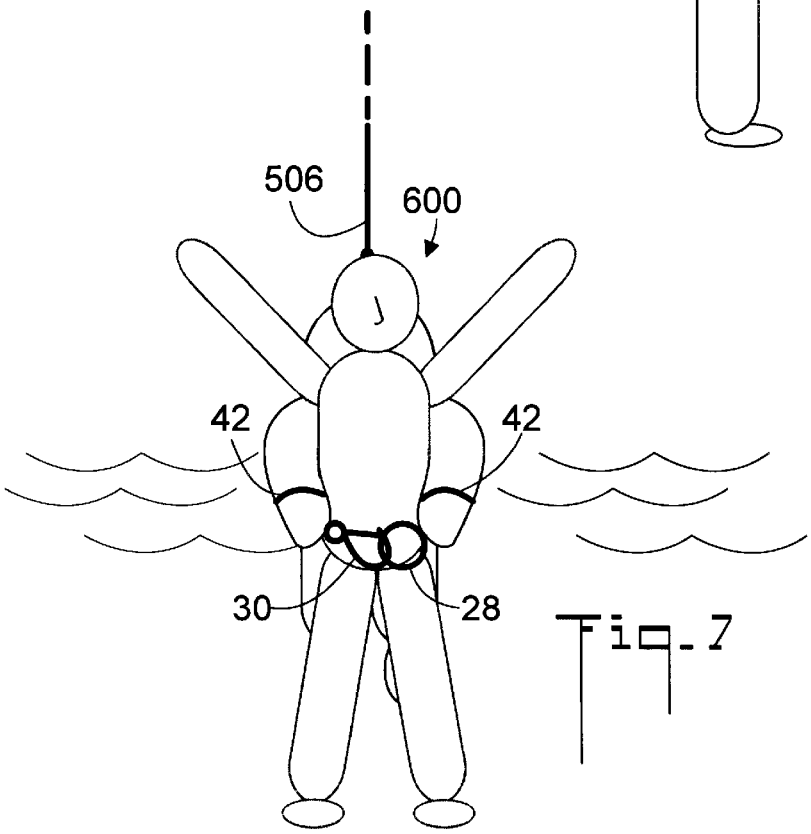

FIGS. 6 and 7 are reduced side elevation and front elevation views respectively of rescuer 700 placing and locking capture strap 20 around a person 600 being rescued. Rescuer 700 reaches out and places his arms around person 600, and connects first metal connector 28 to second metal connector 30. The rescuer 700 then moves his wrists outwardly to tighten capture strap 20 around the person 600 being rescued. It will be appreciated that while FIGS. 6 and 7 show the victim facing away from the rescuer, the victim may also face the rescuer and/or be unconscious.

In terms of use, a rescuer 700 wears a rescue harness 500. Capture strap 20 is connected to the rescue harness 500, preferably by a pair of harness connectors 32 and 34 on capture strap 20 and a pair of cooperating chest receptacles 502 on rescue harness 500. Rescuer 700 is then placed adjacent to the person 600 to be rescued, such as by suspending rescuer 700 downstream of a floating person 600. Rescuer 700 places capture strap around the person 600 and connects the first 28 and second 30 metal connectors together.

DESCRIPTION OF CONNECTORS AND BUCKLES

The following connectors and buckles utilized on harness 20 are available from United States Forgecraft Corp. of Fort Smith, Ark.:

first metal connector 28—parachute harness, P/N 22046-1;

second metal connector 30—rope snap, ladder hook, P/N 3029A;

spaced apart harness connectors 32, 34—snap parachute harness, P/N MS 22017; and chinch buckle 40—adjuster, P/N MS 22007-2.

The straps of harness 20 are fabricated from nylon webbing Type VII, in accordance with MIL-W-4088H, such as webbing having product code NWT7U available from Unitex Inc. of Los Angeles, Calif.

The preferred embodiments of the invention described herein are exemplary and numerous modifications, dimensional variations, and rearrangements can be readily envisioned to achieve an equivalent result, all of which are intended to be embraced within the scope of the appended claims.

I claim:

1. A method for rescuing a person, comprising:

(1) providing a rescue harness having two spaced apart chest receptacles;

(2) providing a capture strap, said capture strap adapted to be detachably attached to said rescue harness, said capture strap having:

a first end and an opposite second end;

a first metal connector connected to said first end;

a second metal connector connected to said second end, said second metal connector removably connectable to said first metal connector;

said first metal connector including a ring, and said second metal connector including a snap having a spring loaded gate which engages said ring;

two spaced apart harness connectors removably connectable to said two spaced apart chest receptacles;

(3) providing a rescuer;

(4) providing a person to be rescued, said person to be rescued having a near side and an opposite far side;

(5) placing said rescue harness on said rescuer;

(6) connecting said two spaced apart harness connectors to said two spaced apart chest receptacles;

(7) causing said rescuer to be placed adjacent to said person being rescued wherein said rescuer is suspended in an angled forward facing position, and wherein said rescuer is facing said near side of said person to be rescued;

(8) connector in one hand and said second metal connector in another hand;

(9) said rescuer placing his/her arms around said person to be rescued so that said first and second metal connectors are disposed on said far side of said person being rescued; and,

(10) said rescuer connecting said first metal connector to said second metal connector so that said capture strap surrounds said person being rescued.

2. The method according to claim 1, further including:

said capture strap including two looped wrist straps for receiving the wrists of said rescuer; and, prior to step (8), said rescuer placing his or her wrists through said looped wrist straps.

3. The method according to claim 2, further including:

after step (10), said rescuer moving his wrists outwardly to tighten said capture strap around the person being rescued.

* * * * *

UNITED STATES PATENT AND TRADEMARK OFFICE

CERTIFICATE OF CORRECTION

PATENT NO. : 6,367,583 B1
DATED : April 9, 2002
INVENTOR(S) : Ronald C. Derby

It is certified that error appears in the above-identified patent and that said Letters Patent is hereby corrected as shown below:

Column 4,
Line 47, step (8) should read as follows:
-- (8) said rescuer grasping said first metal connector in one hand and said second metal connector in another hand; --

Signed and Sealed this

Fifteenth Day of October, 2002

*Attest:*

*Attesting Officer*

JAMES E. ROGAN
*Director of the United States Patent and Trademark Office*